US011436990B2

(12) United States Patent
Xi et al.

(10) Patent No.: US 11,436,990 B2
(45) Date of Patent: Sep. 6, 2022

(54) GOA DEVICE AND GATE DRIVING CIRCUIT

(71) Applicant: TCL China Star Optoelectronics Technology Co., Ltd., Shenzhen (CN)

(72) Inventors: Suping Xi, Shenzhen (CN); Tianhong Wang, Shenzhen (CN)

(73) Assignee: TCL China Star Optoelectronics Technology Co., Ltd., Shenzhen (CN)

( * ) Notice: Subject to any disclaimer, the term of this patent is extended or adjusted under 35 U.S.C. 154(b) by 0 days.

(21) Appl. No.: 16/617,168

(22) PCT Filed: Sep. 9, 2019

(86) PCT No.: PCT/CN2019/104923
§ 371 (c)(1),
(2) Date: Nov. 26, 2019

(87) PCT Pub. No.: WO2021/007938
PCT Pub. Date: Jan. 21, 2021

(65) Prior Publication Data

US 2022/0238080 A1 Jul. 28, 2022

(30) Foreign Application Priority Data

Jul. 18, 2019 (CN) ..... 201910648472.0

(51) Int. Cl.
*G09G 3/36* (2006.01)

(52) U.S. Cl.
CPC ... *G09G 3/3677* (2013.01); *G09G 2300/0426* (2013.01)

(58) Field of Classification Search
CPC ..... G09G 3/3677; G09G 2300/0426
See application file for complete search history.

(56) References Cited

U.S. PATENT DOCUMENTS

| | | | | |
|---|---|---|---|---|
| 6,147,362 | A | 11/2000 | Keyser | |
| 2011/0266546 | A1* | 11/2011 | You | H01L 27/1255 438/34 |
| 2012/0050633 | A1 | 3/2012 | Chen et al. | |
| 2015/0207503 | A1 | 7/2015 | Xu et al. | |
| 2016/0260403 | A1 | 9/2016 | Dai | |
| 2017/0270886 | A1 | 9/2017 | Yu | |

(Continued)

FOREIGN PATENT DOCUMENTS

| | | | |
|---|---|---|---|
| CN | 102708824 | A | 10/2012 |
| CN | 104064158 | A | 9/2014 |
| CN | 104715724 | A | 6/2015 |

(Continued)

*Primary Examiner* — Liliana Cerullo
(74) *Attorney, Agent, or Firm* — Menachem Nathan; Nathan & Associates

(57) ABSTRACT

A gate on array (GOA) device and a gate driving circuit are provided. The GOA device includes at least two GOA units. Each of the at least two GOA units includes at least one pull-down maintenance unit. The pull-down maintenance unit at least includes a first thin film transistor. The first thin film transistor includes a base substrate, a first electrode, a second electrode, and a third electrode. An electric potential of the first electrode is different from an electric potential of the second electrode. The first electrode or the second electrode is electrically connected to the third electrode.

12 Claims, 5 Drawing Sheets

(56) References Cited

U.S. PATENT DOCUMENTS

2018/0351103 A1* 12/2018 Liu ..... H01L 21/77

FOREIGN PATENT DOCUMENTS

| | | | |
|---|---|---|---|
| CN | 106448606 | A | 2/2017 |
| CN | 109166896 | A | 1/2019 |
| CN | 109378326 | A | 2/2019 |
| CN | 109976049 | A | 7/2019 |
| EP | 0968533 | A1 | 1/2000 |

* cited by examiner

GOA DEVICE AND GATE DRIVING CIRCUIT

FIELD

The present disclosure relates to display panel technologies, and more particularly, to a gate on array (GOA) device and a gate driving circuit.

BACKGROUND

Gate on array (GOA) technologies integrate a scan line driving circuit on an array substrate of a liquid crystal panel, thereby reducing product costs in terms of material costs and manufacturing process.

An existing gate driving circuit includes a pull-down maintaining module for maintaining a low level of the scan level signal of a current stage and the scan signal of the current stage. However, a threshold voltage of a thin film transistor is shifted due to long-term forward pressure of the thin film transistor in the pull-down maintaining module. When the gate driving circuit is operated for a long time, electrical properties of the thin film transistor in the pull-down sustaining module will be impaired, so that the pull-down maintaining module cannot pull down a potential of a corresponding position, which affects the output of a gate waveform in a display panel.

Therefore, prior art has drawbacks and is in urgent need of improvement.

SUMMARY

In view of the above, the present disclosure provides gate on array (GOA) device and a gate driving circuit to achieve a narrow border design of a display panel.

In order to achieve above-mentioned object of the present disclosure, one embodiment of the disclosure provides a GOA device, including at least two GOA units. Each of the at least two GOA units includes a pull-down maintenance module. The pull-down maintenance module includes at least one pull-down maintenance unit.

The pull-down maintenance unit at least includes a first thin film transistor.

The first thin film transistor includes a base substrate, a first electrode disposed on the base substrate, a second electrode disposed on the first electrode, and a third electrode disposed on the base substrate.

An electric potential of the first electrode is different from an electric potential of the second electrode. The first electrode or the second electrode is electrically connected to the third electrode.

In one embodiment of the disclosure, the first thin film transistor further includes a gate layer disposed on the base substrate, and a first source/drain layer disposed on the gate layer.

The first electrode and the gate layer are at the same layer.

The second electrode and the first source/drain layer are at the same layer.

In one embodiment of the disclosure, the first thin film transistor further includes a shading layer disposed between the base substrate and the first electrode. The third electrode and the shading layer are at the same layer.

The third electrode is electrically connected to the first electrode or the second electrode by a first via hole.

In one embodiment of the disclosure, the first thin film transistor further includes a second source/drain layer disposed on the first source/drain layer. The third electrode and the second source/drain layer are at the same layer.

The third electrode is electrically connected to the second electrode by a second via hole.

In one embodiment of the disclosure, the first thin film transistor further includes a pixel electrode layer disposed on the first source/drain layer. The third electrode and the pixel electrode layer are at the same layer.

The third electrode is electrically connected to the second electrode by a third via hole.

In one embodiment of the disclosure, the third electrode is disposed on the second electrode and contacted with a surface of the second electrode opposite to another surface of the second electrode facing the base substrate.

In one embodiment of the disclosure, the first thin film transistor further includes an interlayer insulated layer disposed between the first source/drain layer and the pixel electrode layer.

A thickness of the second electrode and a thickness of the interlayer insulated layer are the same.

The third electrode and the pixel electrode layer are at the same layer.

In one embodiment of the disclosure, the pull-down maintenance unit further includes a second thin film transistor.

The third electrode is extended from the first thin film transistor to the second thin film transistor.

In one embodiment of the disclosure, each of the least two GOA units further includes:

a pull-up controlling module configured to receive a first scanning signal and to produce a scanning electric level signal of a current stage according to a control of the first scanning signal;

a pull-up module configured to pull up a scanning signal of the current stage according to the scanning electric level signal of the current stage and a time signal of the current stage;

a pull-down module configured to output a second low electric level from a constant low electric level source to an output end of the scanning signal of the current stage; and a bootstrap capacitor configured to produce a high electric level of the scanning electric level signal of the current stage.

Furthermore, another embodiment of the disclosure provides a gate driving circuit including a time signal source, a constant low electric level source, and a GOA device. The GOA device includes at least two GOA units. Each of the at least two GOA units includes a pull-down maintenance module. The pull-down maintenance module includes at least one pull-down maintenance unit.

The pull-down maintenance unit at least includes a first thin film transistor.

The first thin film transistor includes a base substrate, a first electrode disposed on the base substrate, a second electrode disposed on the first electrode, and a third electrode disposed on the base substrate.

An electric potential of the first electrode is different from an electric potential of the second electrode. The first electrode or the second electrode is electrically connected to the third electrode.

In one embodiment of the gate driving circuit of the disclosure, the first thin film transistor further includes a gate layer disposed on the base substrate, and a first source/drain layer disposed on the gate layer.

The first electrode and the gate layer are at the same layer.

The second electrode and the first source/drain layer are at the same layer.

In one embodiment of the gate driving circuit of the disclosure, the first thin film transistor further includes a shading layer disposed between the base substrate and the first electrode. The third electrode and the shading layer are at the same layer.

The third electrode is electrically connected to the first electrode or the second electrode by a first via hole.

In one embodiment of the gate driving circuit of the disclosure, the first thin film transistor further includes a second source/drain layer disposed on the first source/drain layer. The third electrode and the second source/drain layer are at the same layer.

The third electrode is electrically connected to the second electrode by a second via hole.

In one embodiment of the gate driving circuit of the disclosure, the first thin film transistor further includes a pixel electrode layer disposed on the first source/drain layer. The third electrode and the pixel electrode layer are at the same layer.

The third electrode is electrically connected to the second electrode by a third via hole.

In one embodiment of the gate driving circuit of the disclosure, the third electrode is disposed on the second electrode and contacted with a surface of the second electrode opposite to another surface of the second electrode facing the base substrate.

In one embodiment of the gate driving circuit of the disclosure, the first thin film transistor further includes an interlayer insulated layer disposed between the first source/drain layer and the pixel electrode layer.

A thickness of the second electrode and a thickness of the interlayer insulated layer are the same.

The third electrode and the pixel electrode layer are at the same layer.

In one embodiment of the gate driving circuit of the disclosure, the pull-down maintenance unit further includes a second thin film transistor.

The third electrode is extended from the first thin film transistor to the second thin film transistor.

In one embodiment of the gate driving circuit of the disclosure, each of the least two GOA units further includes:

a pull-up controlling module configured to receive a first scanning signal and to produce a scanning electric level signal of a current stage according to a control of the first scanning signal;

a pull-up module configured to pull up a scanning signal of the current stage according to the scanning electric level signal of the current stage and a time signal of the current stage;

a pull-down module configured to output a second low electric level from a constant low electric level source to an output end of the scanning signal of the current stage; and a bootstrap capacitor configured to produce a high electric level of the scanning electric level signal of the current stage.

In comparison with the prior art, one embodiment of the disclosure provides a shunt capacitor to the thin film transistor of the pull-down maintenance module to increase electrical capacitance of a storage capacitor in the thin film transistor. When a threshold voltage of the thin film transistor shift, the shunt capacitor supplements the shifting of the threshold voltage of the thin film transistor. So that the pull-down maintenance module can pull down an electric potential of a corresponding position to ensure an output of a gate waveform in the gate driving circuit.

BRIEF DESCRIPTION OF DRAWINGS

In order to more clearly illustrate embodiments or technical solutions in prior art, drawings to be used in description of the embodiments or the prior art will be briefly described below. Obviously, the drawings in the following description are merely some embodiments of the invention. Considering the drawings, other drawings may be obtained by those of ordinary skill in the art without creative effort.

DETAILED DESCRIPTION

The following description of the embodiments is provided by reference to the following drawings and illustrates the specific embodiments of the present disclosure. Directional terms mentioned in the present disclosure, such as "up," "down," "top," "bottom," "forward," "backward," "left," "right," "inside," "outside," "side," "peripheral," "central," "horizontal," "peripheral," "vertical," "longitudinal," "axial," "radial," "uppermost" or "lowermost," etc., are merely indicated the direction of the drawings. Therefore, the directional terms are used for illustrating and understanding of the application rather than limiting thereof.

One embodiment of the disclosure provides a gate on array (GOA) device, including at least two GOA units.

Figure 1:
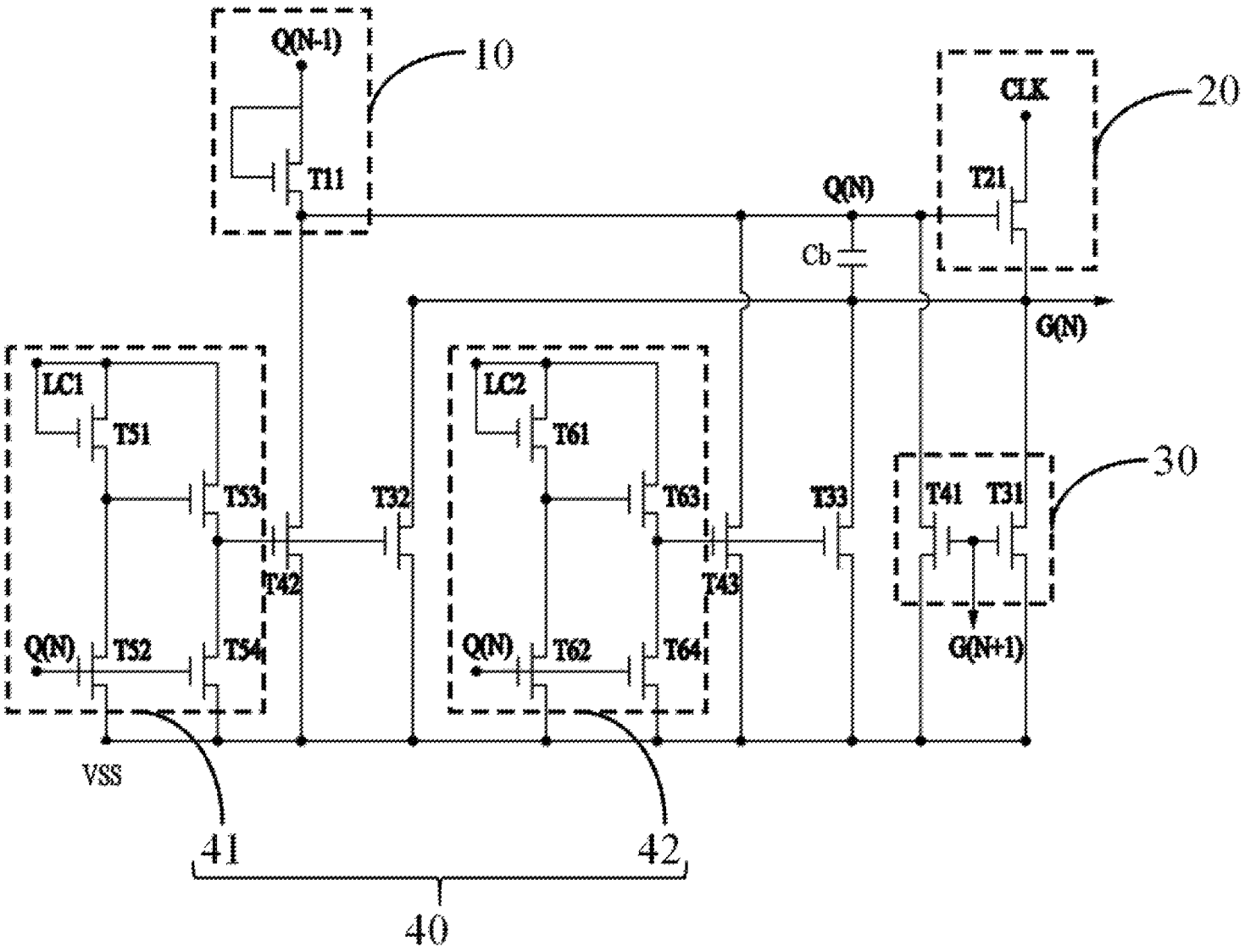
FIG. 1 is a schematic view of a circuit structure of a gate on array (GOA) device according to an embodiment of the invention.

Referring to FIG. 1, FIG. 1 is a schematic view of a circuit structure of the GOA device according to an embodiment of the invention.

The GOA unit includes a pull-up controlling module 10, a pull-up module 20, a pull-down module 30, a pull-down maintenance module 40, and a bootstrap capacitor Cb.

The circuit structure diagram in FIG. 1 further discloses a clock signal source CLK and a constant low electric level source VSS. The clock signal source CLK is used to provide a clock signal of a current stage, and the clock signal includes a first high electric level and a first low electric level. The constant low electric level source VSS is used to provide a second low electric level.

In the embodiment, an output end of the pull-up controlling module 10 is electrically connected to the pull-up module 20, the pull-down module 30, the pull-down maintenance module 40, and the bootstrap capacitor Cb. The constant low electric level source VSS is electrically connected to the pull-down maintenance module 40 and the pull-down module 30. The clock signal source CLK is electrically connected to the pull-up module 20.

The following is an example of an 8 clock (CK) GOA circuit.

The pull-up controlling module 10 is configured to receive a first scanning signal, and to generate a scanning electric level signal of the current stage according to the control of the first scanning signal. The pull-up controlling module 10 includes an eleventh thin film transistor T11.

The pull-up module 20 is configured to pull up a scanning signal of the current stage according to the scanning electric level signal of the current stage and the clock signal CLK of the current stage. The pull-up module 20 includes a twenty-first thin film transistor T21.

The pull-down module 30 is configured to output the second low electric level provided by the constant low electric level source VSS to an output end of the scanning signal of the current stage according to the second scanning signal. The pull-down module 30 includes a thirty-first thin film transistor T31 and a forty-first thin film transistor T41.

The pull-down maintenance module 40 is configured to maintain a low electric level of the scanning electric level signal of the current stage and the scanning signal of the current stage. The pull-down maintenance module 40 includes at least a pull-down maintenance unit. The pull-down maintenance unit includes at least a first thin film transistor.

In this embodiment, the pull-down maintenance module 40 includes at least a first pull-down maintenance unit 41 and a second pull-down maintenance unit 42.

The first pull-down maintenance unit 41 includes a fifty-first thin film transistor T51, a fifty-second thin film transistor T52, a fifty-third thin film transistor T53, and a fifty-fourth thin film transistor T54.

The second pull-down maintenance unit 42 includes a sixty-first thin film transistor T61, a sixty-second thin film transistor T62, a sixty-third thin film transistor T63, and a sixty-fourth thin film transistor T64.

The bootstrap capacitor Cb is used to generate a high electric level of the scanning electric level signal of the current stage. The bootstrap capacitor Cb is disposed between the output end of the pull-up controlling module 10 and the output end of the scanning signal of the current stage.

In this embodiment, the fifty-first thin film transistor T51 in the first pull-down maintenance unit 41 is taken as an example for description. For convenience of description, the fifty-first thin film transistor T51 is named as a first thin film transistor.

Figure 2:
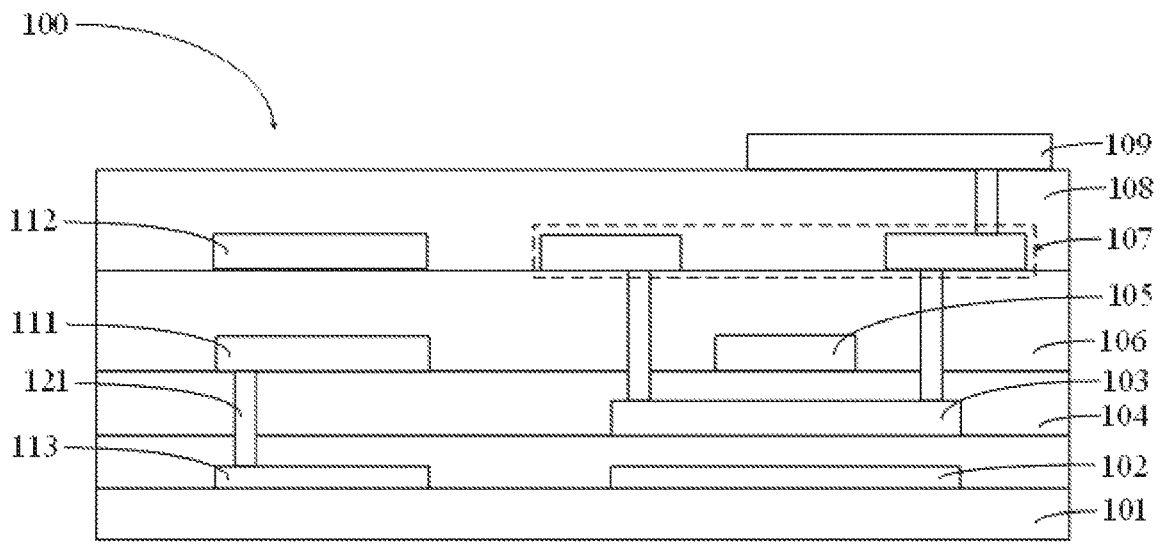
FIG. 2 is a schematic view of a first structure of a first thin film transistor according to an embodiment of the invention.

Referring to FIG. 2, FIG. 2 is a first structural view of a first thin film transistor of the disclosure.

The thin film transistor 21 includes a thin film transistor of etching barrier type, back channel etching type or top gate type, and is not limited in the disclosure.

The embodiment describes a top gate thin film transistor as an example.

The first thin film transistor 100 includes a base substrate 101, an active layer 103 disposed on the substrate 101, a gate insulated layer 104 disposed on the active layer 103, a gate layer 105 disposed on the gate insulated layer 104, an interlayer insulated layer 106 disposed on the gate layer 105, a first source/drain layer 107 disposed on the interlayer insulating layer 106, a passivation layer 108 disposed on the first source/drain layer 107, and a pixel electrode layer 109 disposed on the passivation layer 108.

In the embodiment, the base substrate 101 includes one of a glass substrate, a quartz substrate, a resin substrate, or the like. The substrate 101 includes a flexible substrate, and a material of the flexible substrate includes polyimide.

The first thin film transistor 100 further includes a first electrode 111 disposed on the base substrate 101, a second electrode 112 disposed on the first electrode 111, and a third electrode 113 disposed on the base substrate 101.

In one embodiment, an electric potential of the first electrode 111 is different from an electric potential of the second electrode 112. The first electrode 111 or the second electrode 112 is electrically connected to the third electrode 113.

The first electrode 111 and the second electrode 112 are oppositely disposed to form a first capacitor.

In one embodiment, the third electrode 113 is electrically connected to the first electrode 111 and forms a second capacitor with the first electrode 111. The second capacitor is connected in parallel to the first capacitor to increase a capacitance of the first capacitor.

In another embodiment, the third electrode 113 is electrically connected to the second electrode 112 and forms the second capacitor with the second electrode 112. The second capacitor is connected in parallel to the first capacitor to increase the capacitance of the first capacitor.

In one embodiment, the first electrode 111 and the gate layer 105 are disposed at the same layer. The first electrode 111 and the gate layer 105 are formed in the same mask process.

The second electrode 112 and the first source/drain layer 107 are disposed at the same layer. The second electrode 112 and the first source/drain layer 107 are formed in the same mask process.

Referring to FIG. 2, the first thin film transistor 100 further includes a shading layer 102 disposed between the base substrate 101 and the first electrode 111.

In one embodiment, the third electrode 113 and the shading layer 102 are disposed at the same layer.

The third electrode 113 can be electrically connected to the first electrode 111 or the second electrode 112 through a first via hole 121. In the embodiment, the third electrode 113 is electrically connected to the first electrode 111 through the first via hole 121.

In one embodiment, the third electrode 113 and the light shielding layer 102 are formed in the same mask process.

The first electrode 111 and the second electrode 112 form the first capacitor. The third electrode 113 is electrically connected to the first electrode 111 through the first via hole 121. The third electrode 113 forms the second capacitor with the first electrode 111 and is connected in parallel to the first capacitor to increase the capacitance of the first capacitor.

When a threshold voltage of the first thin film transistor 100 in the first pull-down maintenance unit 41 shifts, an intervention of the second capacitor supplements the offset of the thin film transistor, so that the first thin film transistor 100 works normally. The pull-down maintenance module 40 can pull down an electric potential of a corresponding position to ensure an output of a gate waveform in the gate driving circuit.

Figure 3:
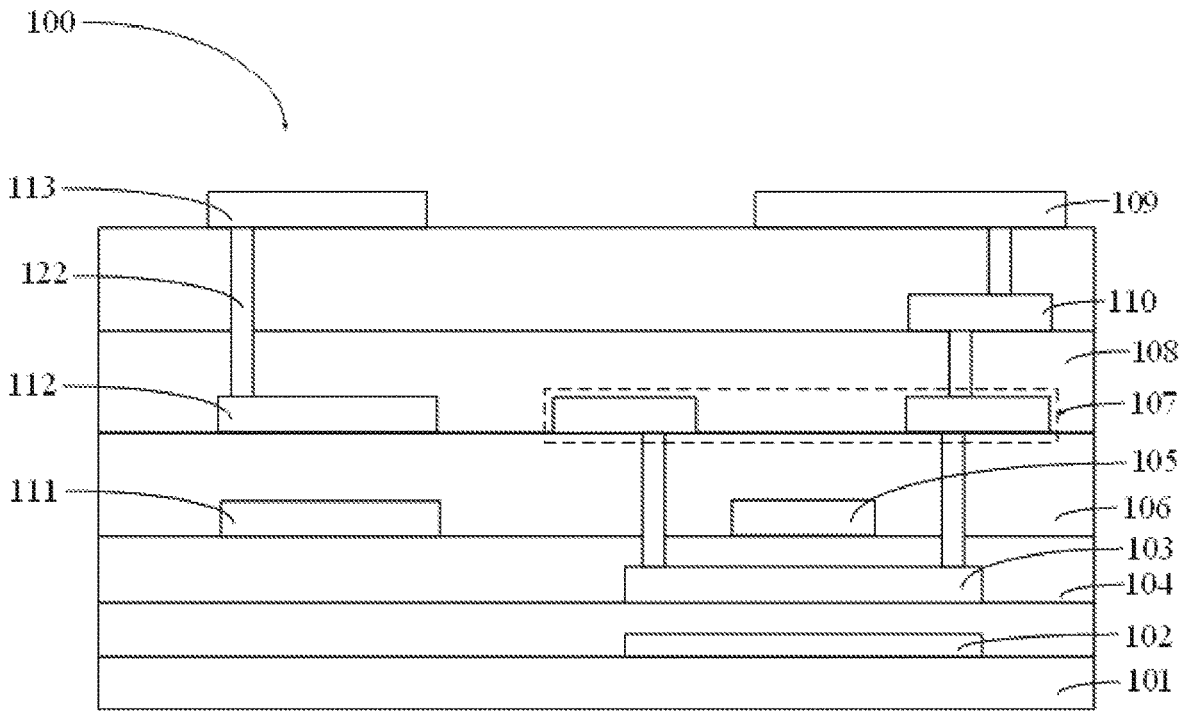
FIG. 3 is a schematic view of a second structure of a first thin film transistor according to an embodiment of the invention.

Referring to FIG. 3, FIG. 3 is a second structural view of the first thin film transistor of the disclosure.

The first thin film transistor 100 further includes a second source/drain layer 110 disposed on the first source/drain layer 107. The third electrode 113 and the second source/drain layer 110 are disposed at the same layer.

The first thin film transistor 100 in the embodiment is a dual source/drain layer structure to reduce impedance of a data line in a display panel.

In the embodiment, the third electrode 113 is electrically connected to the second electrode 112 through the second via hole 122. The electric potential of the third electrode 113 is the same as the electric potential of the second electrode 112. The third electrode 113 and the second electrode 112 form the second capacitor to increase a capacitance of a storage capacitor in the first thin film transistor 100.

Figure 4:
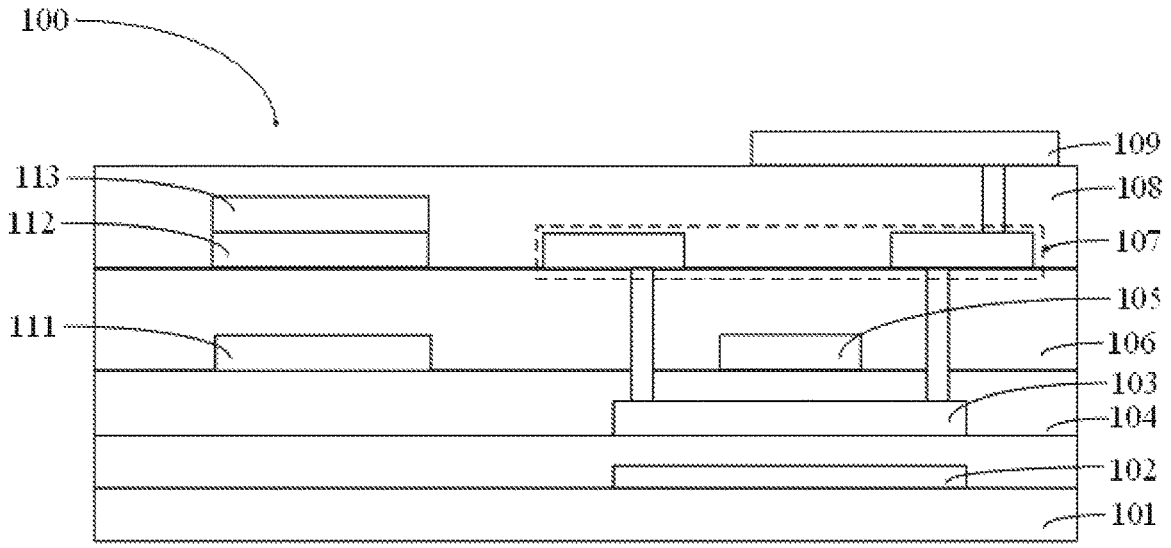
FIG. 4 is a schematic view of a third structure of a first thin film transistor according to an embodiment of the invention.

Referring to FIG. 4, FIG. 4 is a third structural view of the first thin film transistor 100 of the disclosure.

The third electrode 113 is disposed on the second electrode 112 and is in contact with a surface of the second electrode 112 away from the base substrate 101.

A superposition of the third electrode 113 and the second electrode 112 increases charge of an electrode to increase the capacitance of the first capacitor.

Figure 5:
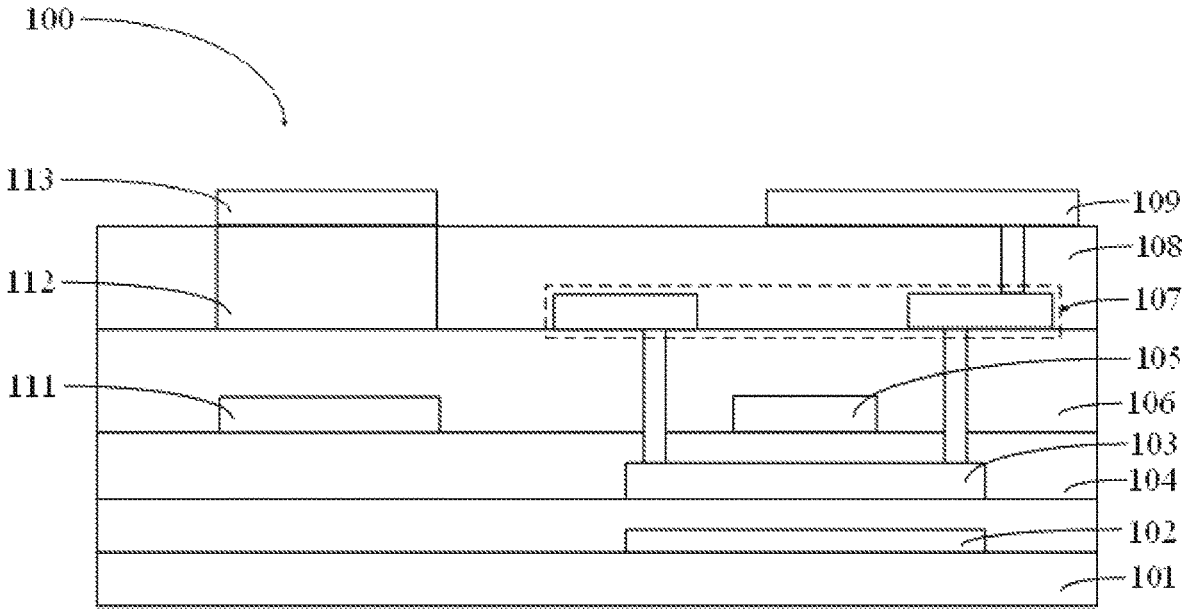
FIG. 5 is a schematic view of a fourth structure of a first thin film transistor according to an embodiment of the invention.

Referring to FIG. 5, FIG. 5 is a fourth structural view of the first thin film transistor of the disclosure.

Based on FIG. 4, the second electrode 112 and the interlayer insulated layer 106 in the embodiment have the same thickness.

The third electrode 113 in the embodiment can be electrically connected to the second electrode 112 without the third via hole 123.

In the embodiment, the third electrode 113 and the pixel electrode layer 109 are disposed at the same layer.

Figure 6:
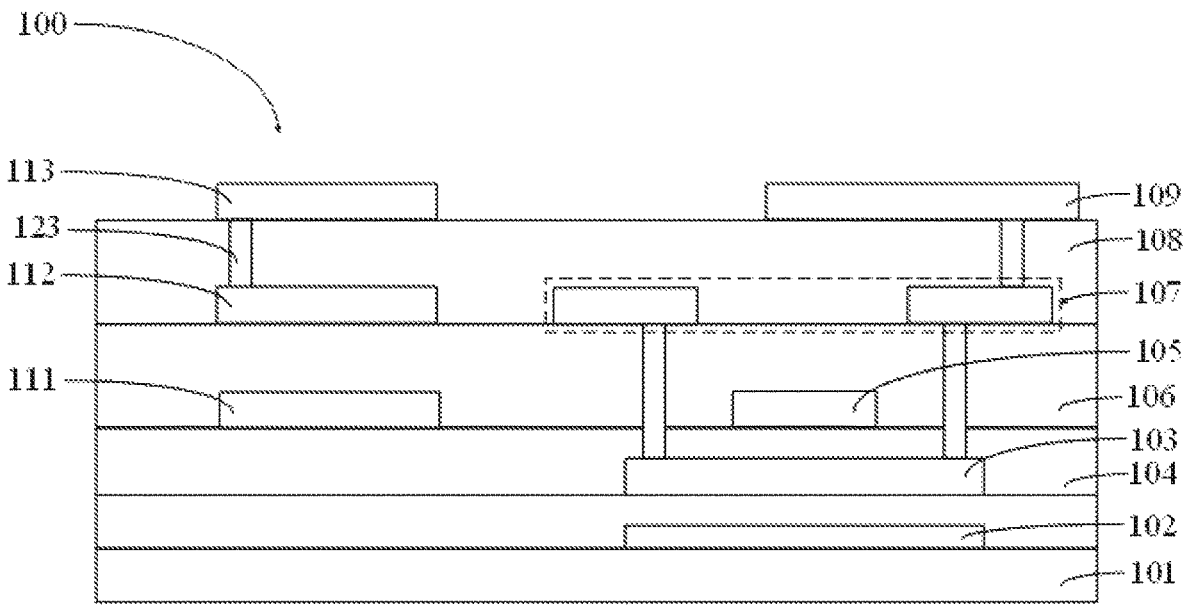
FIG. 6 is a schematic view of a fifth structure of a first thin film transistor according to an embodiment of the invention.

Referring to FIG. 6, FIG. 6 is a fifth structural view of the first thin film transistor of the disclosure.

The third electrode 113 and the pixel electrode layer 109 are disposed at the same layer. The third electrode 113 and the pixel electrode layer 109 are formed in the same mask process.

The third electrode 113 is electrically connected to the second electrode 112 through the third via hole 123.

A working principle of the third electrode 113 in this embodiment is the same as or similar to that of FIGS. 2 to 5, and is not described herein.

Referring to FIG. 1, the first pull-down maintenance unit 41 includes a fifty-first thin film transistor T51, a fifty-second thin film transistor T52, a fifty-third thin film transistor T53, and a fifty-fourth thin film transistor T54. The second pull-down maintenance unit 42 includes a sixty-first thin film transistor T61, a sixty-second thin film transistor T62, a sixty-third thin film transistor T63, and a sixty-fourth thin film transistor T64. Therefore, the first thin film transistor 100 may be any of the above thin film transistors.

In the embodiment, the embodiments of FIGS. 2-6 can be applied to at least one thin film transistor of the pull-down maintenance module.

Figure 7:
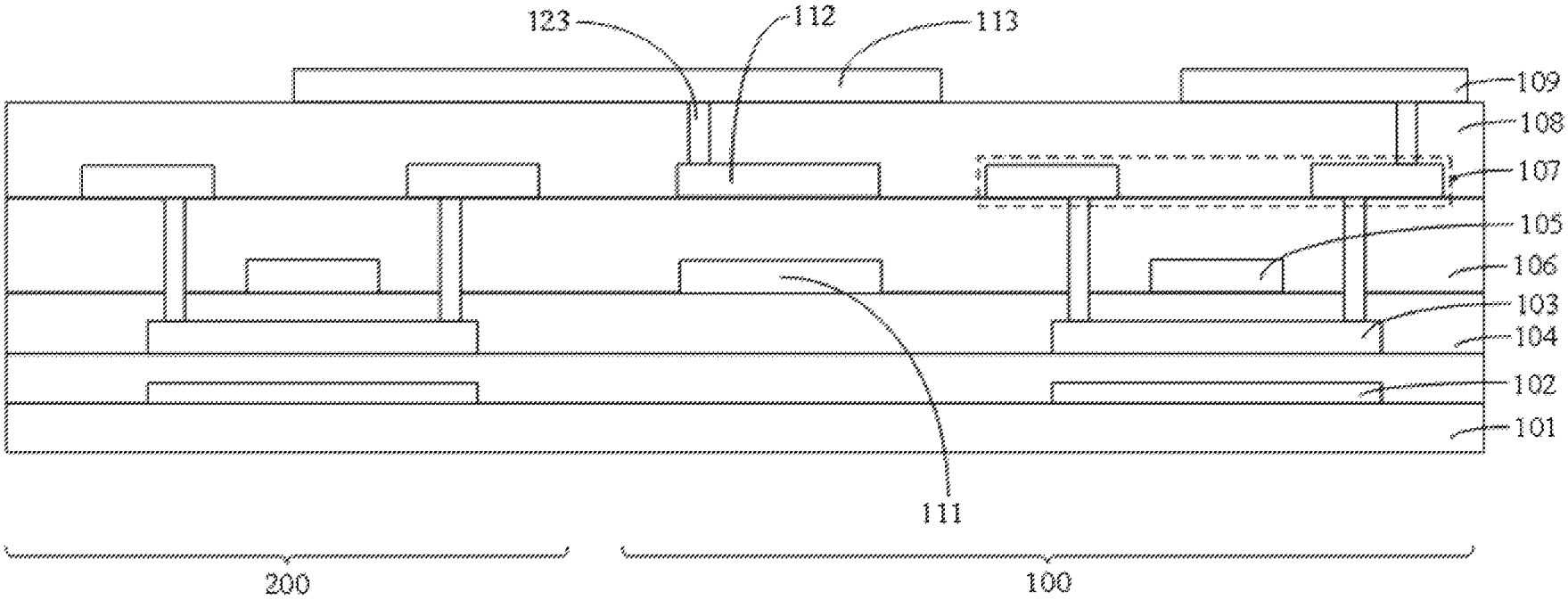
FIG. 7 is a schematic view of a sixth structure of a first thin film transistor according to an embodiment of the invention.

Referring to FIG. 7, FIG. 7 is a sixth structural view of the first thin film transistor of the disclosure.

The first pull-down maintenance unit 41 further includes a second thin film transistor 200.

The second thin film transistor 200 may be any one different from the first thin film transistors 100 of the first pull-down maintenance unit 41.

In the embodiment, the third electrode 113 extends from the first thin film transistor 100 to the second thin film transistor 200.

The disclosure also provides a gate driving circuit including a clock signal source, a constant low electric level source, and the above GOA device. The working principle of the gate driving circuit is the same as or similar to that of the above GOA device, and is not described herein.

The present application also provides a display panel including the above-described gate driving circuit. The working principle of the display panel is the same as that of the above-mentioned gate driving circuit, and is not described herein again.

In comparison with the prior art, one embodiment of the disclosure provides a GOA device and a gate driving circuit. The GOA device includes at least two GOA units. Each of the at least two GOA units includes at least one pull-down maintenance module. The pull-down maintenance module at least includes a first thin film transistor. The first thin film transistor includes a base substrate, a first electrode, a second electrode, and a third electrode. An electric potential of the first electrode is different from an electric potential of the second electrode. The first electrode or the second electrode is electrically connected to the third electrode. The disclosure provides a shunt capacitor to the thin film transistor of the pull-down maintenance module to increase electrical capacitance of a storage capacitor in the thin film transistor. When a threshold voltage of the thin film transistor shift, the shunt capacitor supplements the shifting of the threshold voltage of the thin film transistor. So that the pull-down maintenance module can pull down an electric potential of a corresponding position to ensure an output of a gate waveform in the gate driving circuit.

The present disclosure has been described by the above embodiments, but the embodiments are merely examples for implementing the present disclosure. It must be noted that the embodiments do not limit the scope of the invention. In contrast, modifications and equivalent arrangements are intended to be included within the scope of the invention.

What is claimed is:

1. A gate on array (GOA) device, comprising at least two GOA units, wherein each of the at least two GOA units comprises a pull-down maintenance module, and the pull-down maintenance module comprises at least one pull-down maintenance unit;

wherein the pull-down maintenance unit at least comprises a first thin film transistor; and wherein the first thin film transistor comprises:

a base substrate;

a first electrode disposed on the base substrate;

a second electrode disposed on the first electrode, wherein an electric potential of the first electrode is different from an electric potential of the second electrode;

a third electrode disposed on the base substrate, wherein the first electrode or the second electrode is electrically connected to the third electrode;

a gate layer disposed on the base substrate; and a first source/drain layer disposed on the gate layer;

wherein the first electrode and the gate layer are at the same layer; and wherein the second electrode and the first source/drain layer are at the same layer;

wherein the third electrode is disposed on the second electrode and contacted with a surface of the second electrode opposite to another surface of the second electrode facing the base substrate.

2. The GOA device according to claim 1, wherein the first thin film transistor further comprises a second source/drain layer disposed on the first source/drain layer, and the third electrode and the second source/drain layer are at the same layer; and wherein the third electrode is electrically connected to the second electrode by a second via hole.

3. The GOA device according to claim 1, wherein the first thin film transistor further comprises a pixel electrode layer disposed on the first source/drain layer, and the third electrode and the pixel electrode layer are at the same layer; and wherein the third electrode is electrically connected to the second electrode by a third via hole.

4. The GOA device according to claim 1, wherein the first thin film transistor further comprises an interlayer insulated layer disposed between the first source/drain layer and the pixel electrode layer;

wherein a thickness of the second electrode and a thickness of the interlayer insulated layer are the same; and wherein the third electrode and the pixel electrode layer are at the same layer.

5. The GOA device according to claim 1, wherein the pull-down maintenance unit further comprises a second thin film transistor; and wherein the third electrode is extended from the first thin film transistor to the second thin film transistor.

6. The GOA device according to claim 1, wherein each of the least two GOA units further comprises:

a pull-up controlling module configured to receive a first scanning signal and to produce a scanning electric level signal of a current stage according to a control of the first scanning signal;

a pull-up module configured to pull up a scanning signal of the current stage according to the scanning electric level signal of the current stage and a time signal of the current stage;

a pull-down module configured to output a second low electric level from a constant low electric level source to an output end of the scanning signal of the current stage; and a bootstrap capacitor configured to produce a high electric level of the scanning electric level signal of the current stage.

7. A gate driving circuit, comprising a time signal source, a constant low electric level source, and a gate on array (GOA) device, wherein the GOA device comprises at least two GOA units, wherein each of the at least two GOA units comprises a pull-down maintenance module, and the pull-down maintenance module comprises at least one pull-down maintenance unit;

wherein the pull-down maintenance unit at least comprises a first thin film transistor; and wherein the first thin film transistor comprises:

a base substrate;

a first electrode disposed on the base substrate;

a second electrode disposed on the first electrode, wherein an electric potential of the first electrode is different from an electric potential of the second electrode;

a third electrode disposed on the base substrate, wherein the first electrode or the second electrode is electrically connected with the third electrode;

a gate layer disposed on the base substrate; and a first source/drain layer disposed on the gate layer;

wherein the first electrode and the gate layer are at the same layer; and wherein the second electrode and the first source/drain layer are at the same layer;

wherein the third electrode is disposed on the second electrode and contacted with a surface of the second electrode opposite to another surface of the second electrode facing the base substrate.

8. The gate driving circuit according to claim 7, wherein the first thin film transistor further comprises a second source/drain layer disposed on the first source/drain layer, and the third electrode and the second source/drain layer are at the same layer; and wherein the third electrode is electrically connected to the second electrode by a second via hole.

9. The gate driving circuit according to claim 7, wherein the first thin film transistor further comprises a pixel electrode layer disposed on the first source/drain layer, and the third electrode and the pixel electrode layer are at the same layer; and wherein the third electrode is electrically connected to the second electrode by a third via hole.

10. The gate driving circuit according to claim 7, wherein the first thin film transistor further comprises an interlayer insulated layer disposed between the first source/drain layer and the pixel electrode layer;

wherein a thickness of the second electrode and a thickness of the interlayer insulated layer are the same; and wherein the third electrode and the pixel electrode layer are at the same layer.

11. The gate driving circuit according to claim 7, wherein the pull-down maintenance unit further comprises a second thin film transistor; and wherein the third electrode is extended from the first thin film transistor to the second thin film transistor.

12. The gate driving circuit according to claim 7, wherein each of the at least two GOA units further comprises:

a pull-up controlling module configured to receive a first scanning signal and to produce a scanning electric level signal of a current stage according to a control of the first scanning signal;

a pull-up module configured to pull up a scanning signal of the current stage according to the scanning electric level signal of the current stage and a time signal of the current stage;

a pull-down module configured to output a second low electric level from a constant low electric level source to an output end of the scanning signal of the current stage; and a bootstrap capacitor configured to produce a high electric level of the scanning electric level signal of the current stage.

* * * * *